United States Patent [19]

Cordill et al.

[11] Patent Number: 4,801,181

[45] **Date of Patent: * Jan. 31, 1989**

[54] ADHESIVE-BONDED MULLION BRACKET FOR HOUSEHOLD REFRIGERATOR

[75] Inventors: Rexford W. Cordill, Evansville; John T. Woods, Scott Township, Vanderburgh County, both of Ind.; Louis W. Fellwock, Sebastian County, Ark.

[73] Assignee: Whirlpool Corporation, Benton Harbor, Mich.

[ * ] Notice: The portion of the term of this patent subsequent to Aug. 23, 2005 has been disclaimed.

[21] Appl. No.: 51,950

[22] Filed: May 19, 1987

[51] Int. Cl.[4] ..... A47B 81/00

[52] U.S. Cl. ..... 312/214

[58] Field of Search ..... 248/221, 3, 224.4; 312/214, 257 SM, 257 R

[56] References Cited

U.S. PATENT DOCUMENTS

| | | | |
|---|---|---|---|
| 2,648,584 | 8/1953 | Morton | 312/214 |
| 3,968,561 | 7/1976 | Oakes et al. | 29/460 |
| 4,094,054 | 6/1978 | Fischer | 29/460 |
| 4,170,391 | 10/1979 | Bottger | 312/214 |
| 4,548,049 | 10/1985 | Rajgopal | 62/275 |
| 4,550,576 | 11/1985 | Tate, Jr. et al. | 62/441 |
| 4,558,503 | 12/1985 | Wilson | 29/446 |
| 4,706,363 | 11/1987 | Taylor | 49/388 X |

*Primary Examiner*—Joseph Falk

*Attorney, Agent, or Firm*—Wood, Dalton, Phillips, Mason & Rowe

[57] ABSTRACT

A refrigerator cabinet includes an outer shell having a transverse flange terminating in a channel generally parallel with the flange and opening transversely inwardly. A liner is disposed within the shell and defines a storage space which is divided into two compartments by a compartment separator. A center rail defines a forward wall for the separator. A pair of brackets each has a first portion shaped to conform to the channel and a second portion shaped to conform to ends of the center rail. An adhesive material is disposed in opposite sides of the channel adjacent the compartment separator and adheres the brackets to the cabinet. Fasteners are provided for securing brackets to the opposite ends of the center rail. Accordingly, a refrigerator cabinet is provided which utilizes an adhesive as the sole means for retaining the center rail brackets to the cabinet structure.

14 Claims, 2 Drawing Sheets

FIG. 1
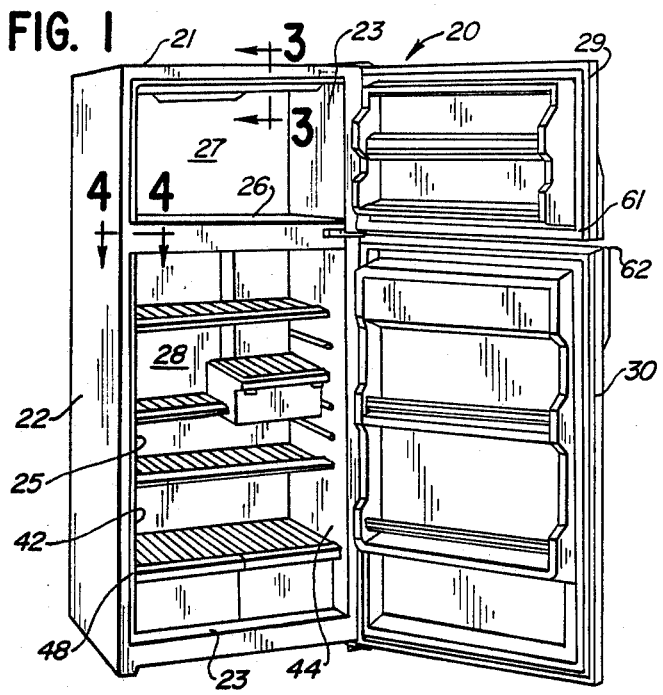
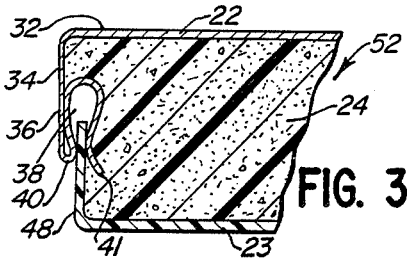
FIG. 3
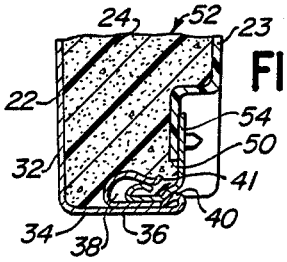
FIG. 4
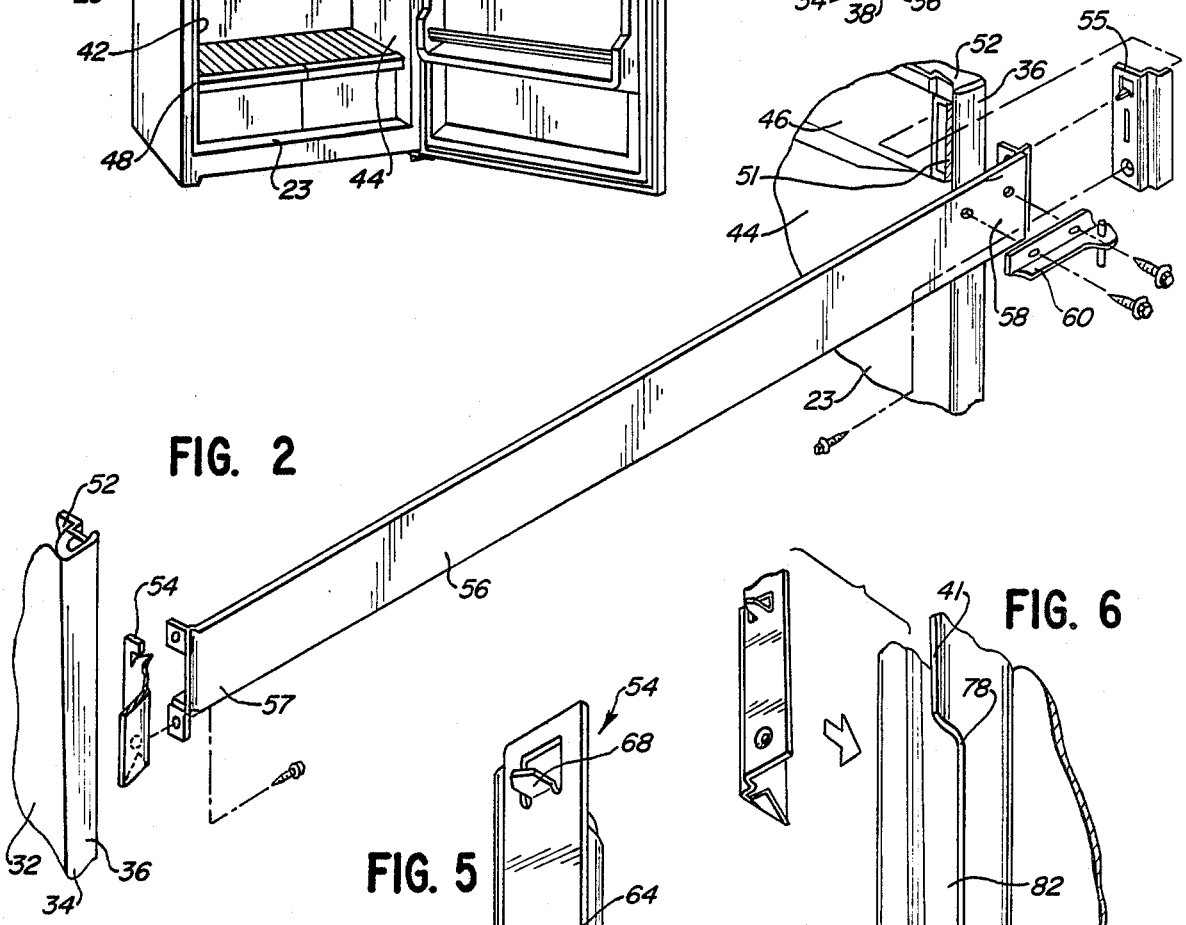
FIG. 2
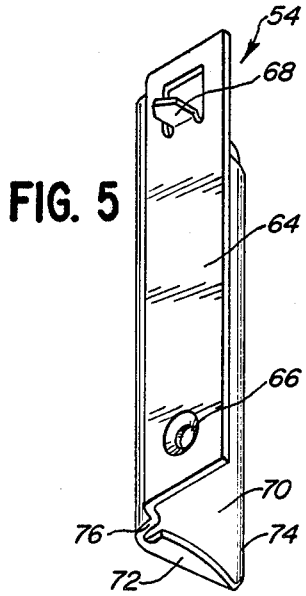
FIG. 5
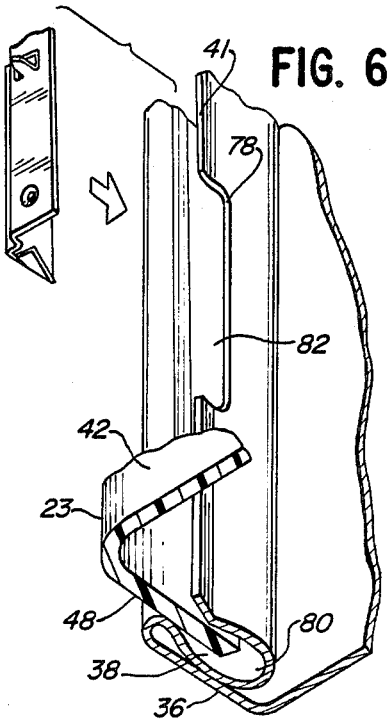
FIG. 6
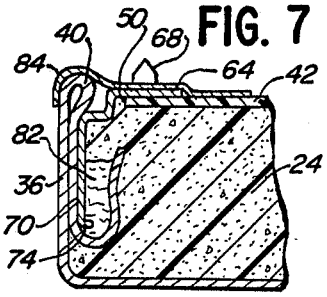
FIG. 7

FIG. 8
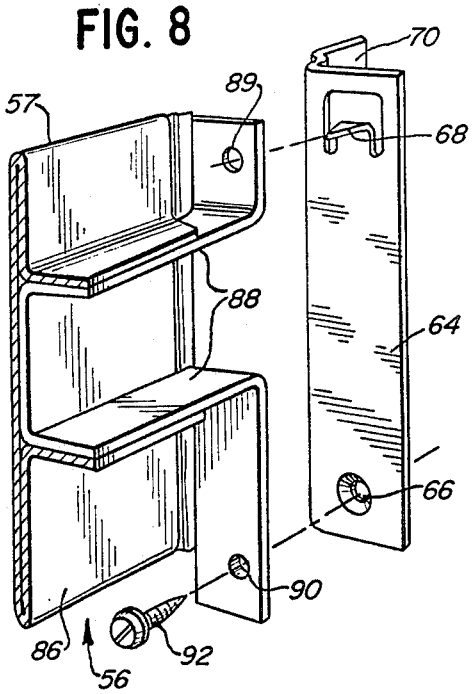
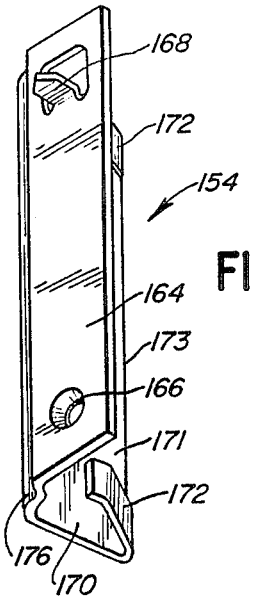
FIG. 9
FIG. 10
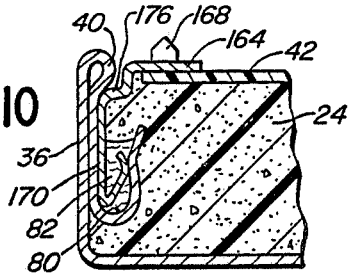
FIG. 11
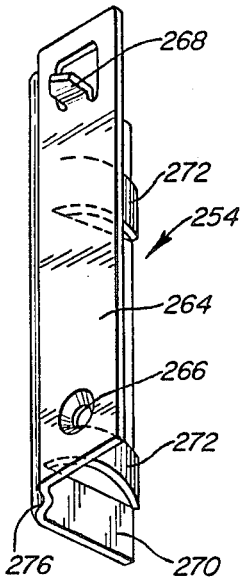
FIG. 12
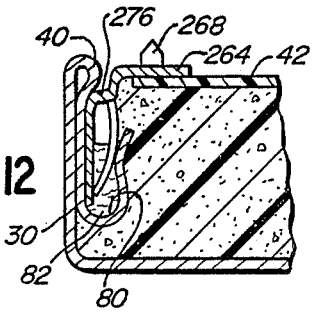

ADHESIVE-BONDED MULLION BRACKET FOR HOUSEHOLD REFRIGERATOR

BACKGROUND OF THE INVENTION

1. Field of the Invention

This invention relates generally to refrigerator cabinets, and more particularly, to an improved center rail assembly for the refrigerator cabinet.

2. Description of Background Art

Conventional refrigerator cabinets include a horizontal insulated wall separating a freezer compartment from a fresh food compartment. A center rail, or mullion, is typically mounted to the cabinet forwardly of the horizontal insulated wall. The center rail provides a surface on which the door gaskets seal, and it decreases side swaying of the cabinet caused by heavy loads in the cabinet doors.

Certain refrigerator cabinets, such as described in Bottpar U.S. Pat. No. 4,170,391, utilize a pair of center rail, or mullion brackets fastened to either side of the cabinet using screws which pass through apertures in a front flange. The center rail is, in turn, fastened to the brackets utilizing a fastener at either end. Such a construction results in fasteners protruding from the face of the cabinet, resulting in a less than desirable construction from an aesthetic standpoint.

Another method for mounting the center rail to the cabinet comprises welding the center rail to either side of the cabinet. However, refrigerator cabinets are conventionally manufactured utilizing prepainted steel. Prepainted steel cannot be readily welded because the paint becomes discolored.

The refrigerator cabinet described in Wilson U.S. Pat. No. 4,558,503 requires a backup plate screwed to the outer shell of the cabinet at either side. A partition bracket is secured at each backup plate, with a crosspiece spanning the cabinet. Such a construction requires visible fasteners to secure the cover plate to the crosspiece. Moreover, this construction requires several additional parts resulting in a refrigerator construction which is more complicated and more expensive to produce.

The present invention overcomes the above problems of prior refrigerator cabinets, in a novel and simple manner.

SUMMARY OF THE INVENTION

In accordance with the present invention, a refrigerator cabinet is provided which eliminates fasteners for securing the center rail to the cabinet which protrude from the front face of the cabinet.

Broadly, there is disclosed herein a novel refrigeration apparatus cabinet structure including a liner defining a space to be refrigerated, the liner having a turned edge. An outer cabinet defines a turned edge having a returned portion defining a channel receiving the turned edge of the liner. A center rail bracket defines a distal edge. A body of adhesive is disposed in a preselected portion only of the channel which receives the edge of the center rail bracket and retains the bracket in the cabinet structure.

The refrigerator apparatus cabinet includes an outer shell comprising connected flat planar members defining outer surfaces of sidewalls turned at front edges thereof to define a planar cabinet flange. The flange is returned to form an inwardly facing channel. A liner is disposed within the shell and has walls defining an internal cabinet space and has outturned edge flange portions received in the channel. A divider wall extends between portions of the channel on opposite sides of the cabinet along a forward edge of the divider wall. A pair of brackets are provided for fastening the center rail to the channel. Each bracket includes a first portion shaped to conform to end portions of the center rail, and second portions shaped to conform to the shape of the channel. An adhesive material is deposited in the channel for adhering the brackets to the shell. Means are provided for fastening the center rail to the brackets.

It is another object of the present invention to provide a refrigerator cabinet utilizing a body of adhesive as the sole means for retaining the brackets in the cabinet structure.

It is yet another object of the present invention to provide an improved method of assembling a refrigeration apparatus cabinet including the step of depositing a body of adhesive in the channel to retain the bracket therein.

It is still another object of the present invention to provide a method of assembling a refrigerator cabinet which utilizes the heat generated by the insulating foam during the in situ foaming process for aiding in the curing of the adhesive.

It is still a further object of the present invention to provide a method of assembling a refrigerator cabinet wherein the mullion brackets can be adjusted during the curing process to properly align the center rail.

In another embodiment, the brackets are provdied with resilient fingers that bias the clip within the channel. The fingers securely retain the clip in the channel while the adhesive is curing.

Further features and advantages of the invention will readily be apparent from the specification and from the drawings.

BRIEF DESCRIPTION OF THE DRAWINGS

FIG. 1 is a perspective view of a refrigerator/freezer apparatus having a center rail assembly embodying the invention;

FIG. 2 is a fragmentary enlarged exploded perspective view illustrating in greater detail the components of the center rail assembly;

FIG. 3 is a sectional view taken along the line 3—3 of FIG. 1;

FIG. 4 is a sectional view taken along the line 4—4 of FIG. 1;

FIG. 5 is a perspective view of a central rail bracket for one embodiment of the invention;

FIG. 6 is a fragmentary exploded perspective view illustrating the mounting of the center rail bracket to the cabinet;

FIG. 7 is a fragmentary, sectional plan view illustrating the bracket of FIG. 5 assembled in the cabinet;

FIG. 8 is a fragmentary, elevation view with parts removed, illustrating the fastening of the center rail to the bracket;

FIG. 9 is a perspective view of a center rail bracket according to an alternative embodiment of the present invention;

FIG. 10 is a fragmentary, sectional plan view illustrating the mounting of the bracket of FIG. 9;

FIG. 11 is a perspective view of a center rail bracket according to another alternative embodiment of the invention; and FIG. 12 is a fragmentary, sectional plan view illustrating the mounting of the bracket of FIG. 11.

DETAILED DESCRIPTION OF THE PREFERRED EMBODIMENT

In the illustrative embodiments of the invention as disclosed in the drawings, a refrigeration apparatus generally designated 20 is shown to include a cabinet 21 defined by an outer metal shell 22 and an inner, synthetic resin liner 23 provided with suitable insulation 24 therebetween. Illustratively, the insulation may comprise foamed-in-place insulation.

Referring to FIG. 1, the liner 23 defines an internal cabinet space 25 to be refrigerated. An insulated divider, or separator, wall 26 extends across the space 25 to divide the space into an upper, below-freezing, freezer compartment 27 and a lower, above-freezing, fresh food compartment 28. The freezer compartment 27 is provided with an upper door 29 for selective access thereto. Similarly, the fresh food compartment 28 is provided with a lower door 30 for providing selective access thereto.

Referring also to FIGS. 2–4, the outer shell 22 includes flat planar sidewalls 32 turned inwardly at a front edge portion 34 thereof to form a front flange 36. Front edge portion 34 is further double-reverse bent to form a channel 38, commonly known as a yoder-channel. Channel 38 has a rounded lip 40 adjacent the front flange 36, and a distal edge 41.

The liner 23 defines left and right sidewalls 42 and 44, respectively, defining an inwardly opening support channel 46 for slidably receiving side edges (not shown) of the separator wall 26. The liner sidewalls 42 and 44 terminate with a transverse outwardly turned edge peripheral flange 48 continuous around its perimeter except for a pair of notches 50 and 51. The notches 50 and 51 are in alignment with the separator wall channel 46. The liner flange 48 is received in the outer shell yoder-channel 38 to define a wall space 52 therebetween. The wall space 52 is filled with the insulation 24, as described above.

A pair of center rail brackets 54 and 55 extend through the notches 50 and 51, respectively, and are received in the yoder-channel 38. The brackets 54 and 55 are secured in the channel 38 in a manner which is described more specifically below. A center rail 56 extends across the storage space 25 in front of the separator wall 26 and is provided with opposite ends 57 and 58, which are fastened to the brackets 54 and 55, respectively. An intermediate hinge 60 is fastened to the center rail right end 58 for hingedly mounting the doors 29 and 30 in conjunction with upper and lower hinges (not shown). The center rail 56 provides a sealing surface for upper and lower door gaskets 61 and 62, respectively. Moreover, the center rail 56, due to its bending stiffness, decreases the cabinet side sway caused by heavy loads in the refrigerator and freezer doors.

The center rail bracket 54, according to one embodiment of the invention, for the left end 57 of the center rail 56, is illustrated in FIG. 5. The bracket 54 is substantially L-shaped and is of steel construction. The bracket 54 includes a first portion 64 having a screw hole 66 and an outwardly extending mounting tab 68 for fastening the center rail left end 57 thereto. The bracket 54 further includes a second portion 70 having turned edges 72 and 74 shaped to conform to the shape of the outer channel 38. An indent portion 76 connects the first and second portions 64 and 70 of the bracket 54.

With reference to FIG. 6, the distal edge 41 of the shell 22 includes a notch 78 adjacent the liner notch 50. During the cabinet assembly process, after the liner flange 48 is received in the yoder-channel 38, a heat-curable adhesive 82 is deposited in a lower open-ended reservoir area 80 of the channel 38 adjacent the notch 78. The adhesive 82 may be, for example, a two-part epoxy formulation. The distal edge 74 of the bracket 54 is inserted into the channel 38 through the liner notch 50 to embed the distal edge 74 in the adhesive. With reference also to FIG. 7, a piece of tape 84 may be used temporarily to prevent movement of the bracket 54 while the adhesive 82 cures. The in situ foaming process is subsequently performed. It has been found that the foam 24 produces heat which aids in the curing of the adhesive 82.

After the divider wall 26 is inserted into the liner channel 46, the center rail 56 is placed along a forward edge of the divider wall 26. Referring also to FIG. 8, a rear wall 86 of the center rail left end 57 includes a rearwardly extending plate 88 having upper and lower apertures 89 and 90, respectively. The spacing between the apertures 89 and 90 corresponds to the spacing between the mounting tab 68 and screw hole 66 on the bracket first portion 64. Accordingly, the bracket mounting tab 68 is received in the center rail end plate upper hole 89. Thereafter, a fastener, such as a screw, 92 is passed through the lower aperture 90 and is threadably received in the bracket screw hole 66. The mounting of the center rail right end 58 to its associated bracket 55 is similar to that described above. The right side bracket 55 is identical to the left side bracket 54 except for being a mirror image thereof.

When the center rail 56 is mounted in the cabinet 22, the opposite sides of the channel 38 are deformed to permit registering of the tabs 68 of each bracket 54 and 55 with the apertures 89 of each center rail end 57 and 58, respectively, so that the tabs 68 retain the center rail 56 when the channels 38 are no longer deformed. The screws 92 provide rigid fastening of the center rail 56.

Therefore, according to the one embodiment of the invention immediately described above, a refrigerator cabinet 22 is provided with a body of adhesive 82 disposed in a channel reservoir 80 defining the sole means for retaining the center rail brackets 54 and 55 in the cabinet structure. Thus, unsightly screws are eliminated from the outer shell front flange 36.

According to another embodiment of the present invention illustrated in FIGS. 9 and 10, a center rail bracket 154 includes a first portion 164 having a screw hole 166 and mounting tab 168 similar to those previously described with reference to FIG. 5. A bracket second portion 170 defines a turned flat wall 171 having a pair of distal resilient fingers 172 extending diagonally inwardly from a distal edge 173. The bracket 154 is formed of, for example, 0.020 inch spring steel, and is heat-treated for proper hardness and spring characterization. When the bracket 154 is mounted in the yoder-channel 38 in a snap-fit manner, the fingers 172 bias a bracket indent portion 176 against the shell front flange outer lip 40. Thus, the fingers 172 resiliently retain the center rail bracket 154 in the channel 38 when the adhesive 82 is deposited in the reservoir 80.

The bracket fingers 172 retain the bracket 154 in position while the adhesive 82 is curing. Additionally, the resiliency of the fingers 172 permits a slight amount of movement of the bracket 154 after the center rail 76 has been fastened thereto in order to permit proper alignment of the center rail 56.

A mounting bracket 254, according to a further embodiment of the present invention, is illustrated in FIGS. 11 and 12. A bracket first portion 264 includes a screw hole 266 and a mounting tab 268 similar to those described with respect to the previous two embodiments. A bracket second portion 270 comprises a turned, substantially flat, planar portion. A pair of resilient fingers 272 extend outwardly from an indented portion 276 of the bracket 254. When the bracket 254 is inserted in the channel 38, the fingers 272 provide a snap-fit retention while the adhesive 82 cures. Again, the fingers 272 bias the bracket indented portion 276 against the rounded lip portion 40 of the shell front flange 36.

With the center rail brackets according to the alternative embodiments of the invention, a refrigerator cabinet is provided with a center rail bracket including resilient fingers which compress on assembly into the cabinet flange channel and hold the bracket in place until the adhesive is deposited in the channel, and cured, and the foam completes the assembly.

Thus, the invention broadly comprehends a cabinet structure utilizing an adhesive for securing a center rail bracket to the cabinet.

The foregoing disclosure of the preferred embodiments is illustrative of the broad inventive concepts comprehended by the invention.

We claim:

1. In a refrigeration apparatus cabinet structure including a liner defining a space to be refrigerated, said liner having an outwardly turned edge, an outer cabinet defining a turned edge having a returned portion defining a channel opening inwardly of said cabinet and receiving said turned edge of the liner, a center rail defining a partition front wall, and a center rail bracket defining a distal edge, the improvement comprising:

a body of adhesive disposed in a preselected portion only of said channel embedding the distal end of said center rail bracket and defining the sole means for retaining the center rail bracket in said cabinet structure.

2. The improvement of claim 1 wherein said preselected portion of said channel comprises an open-ended portion.

3. The improvement of claim 1 wherein said preselected portion comprises a reservoir portion of said channel.

4. In a refrigerator cabinet assembly having an outer shell defining a transverse flange terminating in a channel generally parallel with said flange and opening transversely inwardly of said outer shell, a liner within said shell defining a storage space, a compartment separator dividing said storage space into first and second compartments and defining a forward portion, and a center rail overlaying said separator forward portion and defining a forward wall for said separator, a central rail mounting system comprising:

first and second reservoir portions in opposite sides of said channel adjacent said separator;

first and second brackets;

an adhesive material disposed in said reservoir portions adhering said brackets to said shell; and means for fastening said first and second brackets to opposite ends of said center rail.

5. The center rail mounting system of claim 4 wherein said liner includes a flange received in said channel and a pair of notches are provided in said liner flange adjacent said separator wall receiving said brackets.

6. The center rail mounting system of claim 4 wherein said brackets include a first portion shaped to conform to the ends of said center rail, and a second portion shaped to conform to the shape of said channel.

7. The center rail mounting system of claim 6 wherein said center rail opposite end portions include an aperture, and said brackets include an adjacent outwardly extending mounting tab received in said aperture.

8. The center rail mounting system of claim 6 wherein said center rail opposite end portions include an aperture, and said brackets include an adjacent aperture wherein a threaded fastener passes through said apertures to fasten said center rail to said brackets.

9. In a refrigerator cabinet assembly having an outer shell defining a transverse flange terminating in a channel generally parallel with said flange and opening transversely inwardly of said outer shell, a liner within said shell having sidewalls defining a storage space and terminating with a transverse outwardly turned peripheral flange continuous around its perimeter except for a pair of notches, said liner flange being received in said channel to define a wall space, support means on said liner sidewalls adjacent said notches, and insulation filling said wall spaces, a cabinet partition comprising:

a compartment separator, defining a forward portion, received in said support means dividing said storage space into first and second compartments;

a center rail defining first and second end portions extending between portions of said outer shell flange adjacent said liner notches forwardly from said separator;

first and second brackets;

means for fastening said first and second brackets to said center rail first and second end portions, respectively; and an adhesive material disposed in said channel adjacent said liner flange notches adhering said brackets to said channel.

10. The cabinet partition of claim 9 wherein said brackets include a first portion shaped to conform to the ends of said center rail, and a second portion shaped to conform to the shape of said channel.

11. The cabinet partition of claim 10 wherein said center rail opposite end portions include an aperture, and said brackets include an outwardly extending mounting tabs received in said aperture.

12. The cabinet partition of claim 10 wherein said center rail opposite end portions include an aperture, and said brackets include an adjacent aperture wherein a threaded fastener passes through said apertures to fasten said center rail to said brackets.

13. The cabinet partition of claim 9 wherein said brackets include a turned distal edge embedded in said adhesive.

14. A refrigerator cabinet comprising:

an outer shell comprising connected flat planar sidewalls turned at a front edge to define a cabinet flange, said flange being returned to form an inwardly facing channel with respect to said outer shell;

a liner within said shall having surfaces defining an internal cabinet space and having outturned edge flange portions received in said channel;

a divider wall extending between two said liner surfaces and dividing said cabinet into two compartments;

a center rail extending between portions of said channel on opposite sides of said cabinet along a forward edge of said divider wall;

bracket means for fastening an end portion of said center rail to said channel including a first portion shaped to conform to said end portion of said center rail, and a second portion shaped to conform to the shape of said channel; and an adhesive material disposed in said channel adhering said brackets to said channel.

* * * * *